US011691785B1

(12) United States Patent
Newlands, Sr.

(10) Patent No.: US 11,691,785 B1
(45) Date of Patent: Jul. 4, 2023

(54) DISPENSER WITH SELF-DEPLOYABLE TELESCOPIC ACTUATOR

(71) Applicant: Paulo Roberto Jannotti Newlands, Sr., Rio de Janeiro (BR)

(72) Inventor: Paulo Roberto Jannotti Newlands, Sr., Rio de Janeiro (BR)

( * ) Notice: Subject to any disclaimer, the term of this patent is extended or adjusted under 35 U.S.C. 154(b) by 0 days.

(21) Appl. No.: 18/100,478

(22) Filed: Jan. 23, 2023

Related U.S. Application Data

(60) Provisional application No. 63/334,401, filed on Apr. 25, 2022, provisional application No. 63/307,180, filed on Feb. 7, 2022, provisional application No. 63/304,712, filed on Jan. 31, 2022.

(51) Int. Cl.
*B65D 21/08* (2006.01)
*B65D 83/00* (2006.01)

(52) U.S. Cl.
CPC ..... *B65D 21/086* (2013.01); *B65D 83/0011* (2013.01); *B65D 83/0033* (2013.01)

(58) Field of Classification Search
CPC ..... B65D 83/0011; B65D 83/0033; B65D 21/086
USPC ..... 222/519–525, 386, 398, 405, 390; 401/263–265, 171–176; 604/206, 207, 604/211
See application file for complete search history.

(56) References Cited

U.S. PATENT DOCUMENTS 5,100,252 A * 3/1992 Podolsky ..... A46B 11/0027 401/278
5,992,705 A * 11/1999 Lhuisset ..... B65D 83/0027 222/386
2004/0260247 A1* 12/2004 Veasey ..... A61M 5/31585 604/207
2007/0274768 A1* 11/2007 Hines ..... C11D 3/30 401/265
2009/0275916 A1* 11/2009 Harms ..... A61M 5/24 604/211
2019/0248574 A1* 8/2019 Johanson ..... B05C 17/012
2020/0290791 A1* 9/2020 Jones ..... A24F 47/00

* cited by examiner

*Primary Examiner* — Lien M Ngo

(57) ABSTRACT

A dispensing apparatus for semiliquid and pasty goods divided in two complementary sections being the upper section represented by a package such as a container, fitted with a dispensing nozzle and having an open access at its bottom end through which a self-deployable telescopic actuator comprising threaded tubes and lodged at the lower section of the dispenser is introduced for pushing the stored goods towards the dispensing nozzle.

16 Claims, 12 Drawing Sheets

DISPENSER WITH SELF-DEPLOYABLE TELESCOPIC ACTUATOR

CROSS-REFERENCE TO RELATED APPLICATION—PRIORITY CLAIM

This application claims the benefit of priority to the below listed U.S. Provisional No. 63/304,712, filed on Jan. 31, 2022, for "SELF-DEPLOYED TELESCOPIC ACTUATOR AND DEVICES".

No. 63/307,180 filed on Feb. 7, 2022, for "THREADED TELESCOPIC ACTUATOR".

No. 63/334,401 filed on Apr. 25, 2022, for "ASSEMBLING MODEL FOR TELESCOPIC DISPENSER".

The above-identified provisional patent applications, assigned to the assignee hereof, is incorporated herein by reference in its entirety.

FIELD OF THE INVENTION

The present invention relates to the field of mechanic automation when efficient, practical and cost-effective devices are demanded for coping with human needing such as the application of devices fitted with telescopic advanced solutions, by disclosing a construction method for creating a telescopic actuator comprising tubes fitted with threaded lines at their internal, external and/or at both of their sides, so that it would be possible the insertion of a given sequential number of tubes, one inside the others, aiming the creation of a compact model of self-deployable telescopic actuator which can be used along with other devices, such as the dispenser of the present invention, for lifting, pushing or dispensing things, or even acting as regular telescopic or binocular, and the like.

BACKGROUND

Since long ago, countless actions for creating or improving the functioning principles and utilities of telescopic systems have been attempted and sometimes achieved, as it can be noted through the vast array of devices for this aim available in the market.

For example, still in Jun. 12, 1926, it has been granted by the USPTO to F. J. Bullis the U.S. Pat. No. 1,893,728 for "JACK" in which a simple model of telescopic gear was conceived for lifting objects.

A remarkable evolution in this field has been achieved in Aug. 29, 1989, when it has been granted by the USPTO to Werner the U.S. Pat. No. 4,860,987 for "Adjustable Telescopic Devices", however through the utilization of a threaded spindle which causes his device to be of excessive length.

Another evolutionary example can be found in the U.S. Pat. No. 4,883,186 for "Easy Erecting Telescopic Mast", granted on Nov. 28, 1989, to Werber, Manuel M. which encompass external elements such a mechanical jack connected to a toothed rod with the aim of giving vertical mobility to the system. On Apr. 16, 1996, a Patent for "Telescopic Pump" has been granted to Yang under the U.S. Pat. No. 5,507,626 comprising a manual pump often used to inflate balls and tires, being the primary object of the invention to provide a labor-saving and compact telescopic pump.

On May 17, 2018, it has been granted to Ghazanfari Abbas the U.S. Pat. No. 10,746,349 for "Extendable Cage Telescopic System" comprising "an extendable portable mast or arm to position any payloads such as an antenna or a camera or any other surveillance system at a specified position", which seems to be very useful for the specific applications suggested by the related description. Despite the great evolutions and benefits brought by the state of the art in the utilization field of telescopic devices, there exists a need, however for a compact, light, uncomplicated, inexpensive, self extendable and self-retractable telescopic actuator which, in many applications will allow customers to get not just very simple using facility without any mechanical skill, but also an opportunity for using environmentally correct and sustainable packages materials.

Since some technical problems and shortcomings that the art has not been able to overcome until now, the present invention is being disclosed aiming to mitigate and obviate the afore-mentioned problems.

SUMMARY OF THE INVENTION

The present invention discloses a constructive method for creating devices as from a telescopic actuator which comprises tube segments fitted with threaded lines at their internal, external and/or at both of their sides so that it can be insert a desired number of tubes one in the others aiming the creation of a compact model of telescopic actuator which can be used, along with some other devices for lifting, pushing or dispensing goods, or even as regular telescopic, binocular and the like.

The core of the present invention is based on the utility resulting from the insertion and threading of tube segments provided with internal and/or external threads, hereinafter called simply tubes, fitted with progressively smaller diameters, as from a common base, thus aiming the formatting of a telescopic model, as well as the blocking of its thread lines at a certain point in their courses, causing at that points the locking of the smaller diameter tubes at the larger diameter tubes in which they were inserted so that they can be captured and retained by the tubes of larger diameter, and making that, as from that points on, they will follow the rotary movement of the captured tubes, consequently creating a self-deployable telescopic system equipped with a self-expanding and self-retracting capacity within a controlled path.

Such an effect is obtained primarily, by inserting and threading a given quantity of tubes equipped with internal and external threading lines in the next threaded tube until that a frictional contact between them will cause a blocking effect when their threads meet each other at a common point, which in addition will prevent the tubes from disconnecting from each other, will also limit the extension of their paths when a rotational locking is obtained point so that they will start to rotate together around their own axes whenever an external rotational stimulus is applied to the tube segment that serves as the base for the set and to which all other tubes are connected.

Then, and in order to create an expandable and retractable telescopic system, the referred collection of tube segments has the property of being sequentially threaded into each other, as from the larger diameter base section, inside which, and using their internal thread, a next tube segment, having diameter and external threading lines partially compatible with the diameter and the internal threaded lines of the base, will be inserted therein, in a continuous process that will successively be repeated with the other segments of threaded tubes in the necessary amount to reach the maximum expansion intended for the designed system.

Consequently, and as will be better explained in the detailed description of the drawings, the telescopic system so formed will also bear the property of self limiting the maximum expansion point that each tube segment can reach during its own rotation or during the rotation of the entire telescopic system. which is automatically obtained when asymmetrical portions externally located in the lower section of the inner tube of smaller diameter reaches the portions internally located at the larger tube segment that contains it, which will also prevent all tube segments from being disconnect from each other when rotated, thus fully guaranteeing the overall functionality of the telescopic system as well as its dual self-expansion and self-retract capability, as introduced by the present patent. For the external lower portions of the of the smaller diameter pipe segment to self-lock on the internal top of the larger diameter pipe segment, the insertion described above must start from the bottom to the top, i.e., by inserting the top of the smaller diameter pipe segment into the bottom of the larger diameter pipe segment, and so forth.

Thus, whenever a rotational movement to extend the present telescopic system to its maximum desired limit is applied to the system, the self-locking of the tubes will occur when asymmetric lower portions of any segment of smaller diameter tube touches the upper portions of any segment of larger diameter tube when, due to the asymmetrical shape of both tubes at these points, there will be no more space to continue the threading movement, determining therefore the maximum expansive limit that the system is able to reach, although it will still be possible to rotate the tube segments in the opposite direction previously assumed, thus allowing not only the unlocking of all existing tube segments, but also of the entire telescopic system, which will allow a partial or total retraction of the whole telescopic system.

Feasible methods for building devices and tools that can be synergistically activated by the self-deployable telescopic actuator of the present invention can be obtained in a non-limiting way, through the following alternative examples revealed below:

a) Use of tapered threaded tube segments of progressively smaller internal and external diameters from a common base, in which the smaller diameter threaded tube segments will be progressively introduced, as from their smaller diameter thread sections, into the segments of threaded pipes of larger diameter, from their threaded sections of larger diameter, up to a point where, due to the asymmetry of their internal and external threads, the segments of threaded tubes will lock, one on the other, forcing them to assume the direction of rotation applied for expansion or retraction of the entire system;

b) Use of threaded pipe segments with progressively smaller internal and external diameters from a common base, formed by parallel side walls equipped with internal and external threads, and which contain, both at the base of their external walls, thread portions with a diameter slightly larger than the diameter of the rest of its external threads, or at the top of its internal walls, portions of thread with a diameter slightly larger than the diameter of the rest of its internal threads, so as to cause, at this point of contact between the two, the locking of these tubes, one in the other, thus allowing that together they assume the same rotational movement applied to the entire telescopic assembly;

c) Use of threaded pipe segments with progressively smaller internal and external diameters from a common base, formed by parallel side walls equipped with internal and external threads and which also contain, both on their external and internal walls, threading stroke with diameters slightly larger than the diameter of their threads so that they act as stops that not only prevent the smaller diameter tube from continuing its rotating threading indefinitely until, and consequently, they disconnect from the larger diameter tube they are in inserted, but also to obtain at this point of contact between the two, the locking of both one in the other, thus allowing that together they assume the same rotational movement applied to the entire telescopic assembly.

It is important to emphasize that for the self-expansion of the telescopic system of the present invention to occur, it is necessary that some functional conditions are present.

First, that the threaded tube that serves as the base for the entire system be attached to a common handling support, such a cover sleeve, so that rotational movements to the right or left can be freely applied through manual or electrical external stimulus coming, for instance, from a round rotary knob, being such a rotational movement then transmitted, as kinetic energy, to all other threaded tube segments existing in the telescopic system herewith described.

Second, that all tubes positioned above the basic tube with the largest diameter and which serves as the base for the whole set might be able to assume the same rotational movements synergistically transmitted by the base tube, in such a way that they can move vertically within the tubes in which they are being contained, with the aid of their own external threads, as well as of the internal threads of the larger diameter tubes that hold them, with the exception for the smaller diameter tube which serves as the final end of the system, and that will be in direct touch with the content to be dispensed, for which it will be able to move only vertically, being its axial rotation prevented by feasible means, as it will be depicted by the related drawings.

As will be better explained in the detailed description of the drawings, the telescopic system based on which the patent's fundaments will be explained, has the property of self-limiting the maximum expansion point that each tube segment can reach during its own rotation, or even during the rotation of the entire telescopic system, when a collar located at the outer bottom of the smaller threaded tube meets the collar located at the inner top of the larger tube, which additionally will also prevent that all contiguous tube segments be disconnect from the others when rotated, thus fully guaranteeing the overall functionality of the telescopic system as well as its dual self-expansion and self-retract capability.

The aforementioned features and advantages of the present invention will be more clearly understood hereinafter, as a result of a detailed description of the preferred embodiment, when taken in conjunction with several views of the drawings herewith enclosed, in accordance with the brief description listed below:

FIG. 1 shows a front view of a threaded basic tube used as the first element for the creation of the self-deployable telescopic actuator of the present invention, FIG. 2 shows a preferable model of movable threaded tube to be contiguously inserted throughout the system to assume both the rotational and vertical displacements needed to turn the actuator viable and useful.

FIG. 3A exposes central solid threaded column intended to be the last existing element between the telescopic system and the product to be dispensed.

FIG. 3B discloses a perspective view of the set formed by the central solid threaded column and its piston, upon assembled, Figures from 4A up to 4D disclose the assembling steps to conform the self-deployable telescopic actuator of the present patent.

FIGS. 5A to 5D disclose, in a cut view, the assembling steps to conform the base of dispenser with self-deployable telescopic actuator of the present patent.

FIGS. 6A and 6B disclose, now in perspective view, the assembling steps to conform the base of dispenser with the self-deployable telescopic actuator of the present patent.

FIGS. from 7A to 7C shows in cut view the sequential steps for getting the basic tube smoothly dressed up by a cover sleeve.

FIGS. from 10A to 10C shows in a view from below, an alternative method for fixing the storage container to the self-deployable telescopic actuator.

Figures 10A, 10B, 10C:
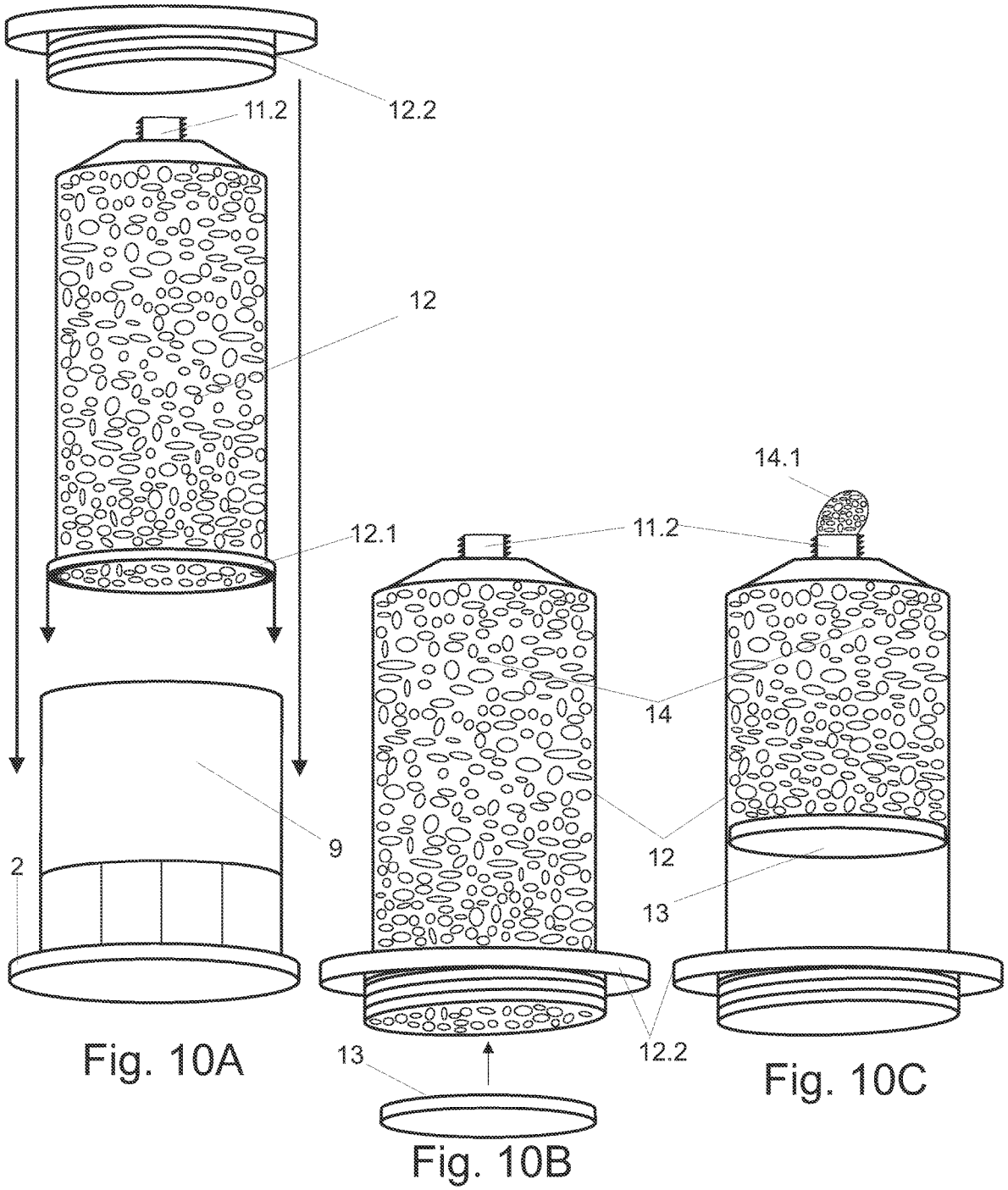

FIGS. from 11A to 11C shows in an upper view the same alternative method for fixing the storage container to the self-deployable telescopic actuator as disclosed by Figures 10A to 10B.

DETAILED DESCRIPTION OF THE DRAWINGS

Figure 1:
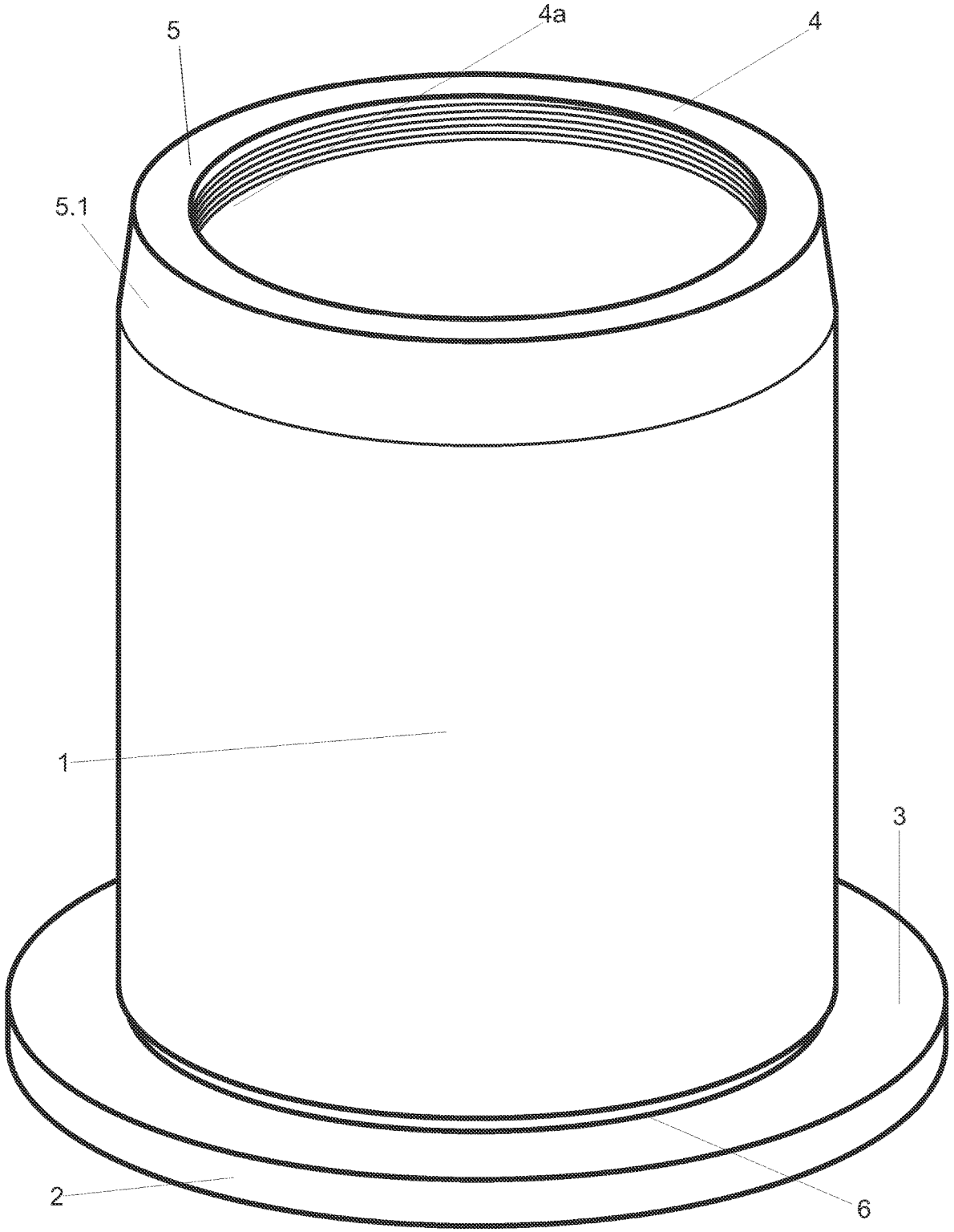

FIG. 1 shows a front view of a threaded basic tube (1) used as the first element for the creation of the self-deployable telescopic actuator of the present invention, fitted with:

a) an outer round driving knob (2) located at its bottom section (3) that will allow the rotation of the entire telescopic set.

b) a groove (6) located between the bottom of the basic threaded tube (1) and the round driving knob (2) which will be used for the insertion and fixture of a preferably segmented inner collar existing at the bottom of a cover sleeve, both depicted on the next figures, responsible for permit the free rotation of the whole set along with the round driving knob (2), also better explained ahead.

c) an inner threaded collar (4) located at the top section (5) of this tube (1) where, in accordance with the objectives present example, the next adjacent and compatible threaded tube will be screwed.

d) an advancement limiter (4*a*).

e) a slanted termination (5.1) of the top section (5) of this tube (1) that is aimed to facilitate the beginning of the insertion of the of a cover sleeve (9) up to its full retention at the groove (6), as shown through figures from 7A to 7C.

This internally threaded basic tube (1) is to be used as the base of the entire telescopic actuator through which ail other threaded tubes that will conform the present actuator will be sequentially inserted as from its open bottom, acting as well as the connection element through which, rotational impulses are transmitted to the whole system.

Figure 2:
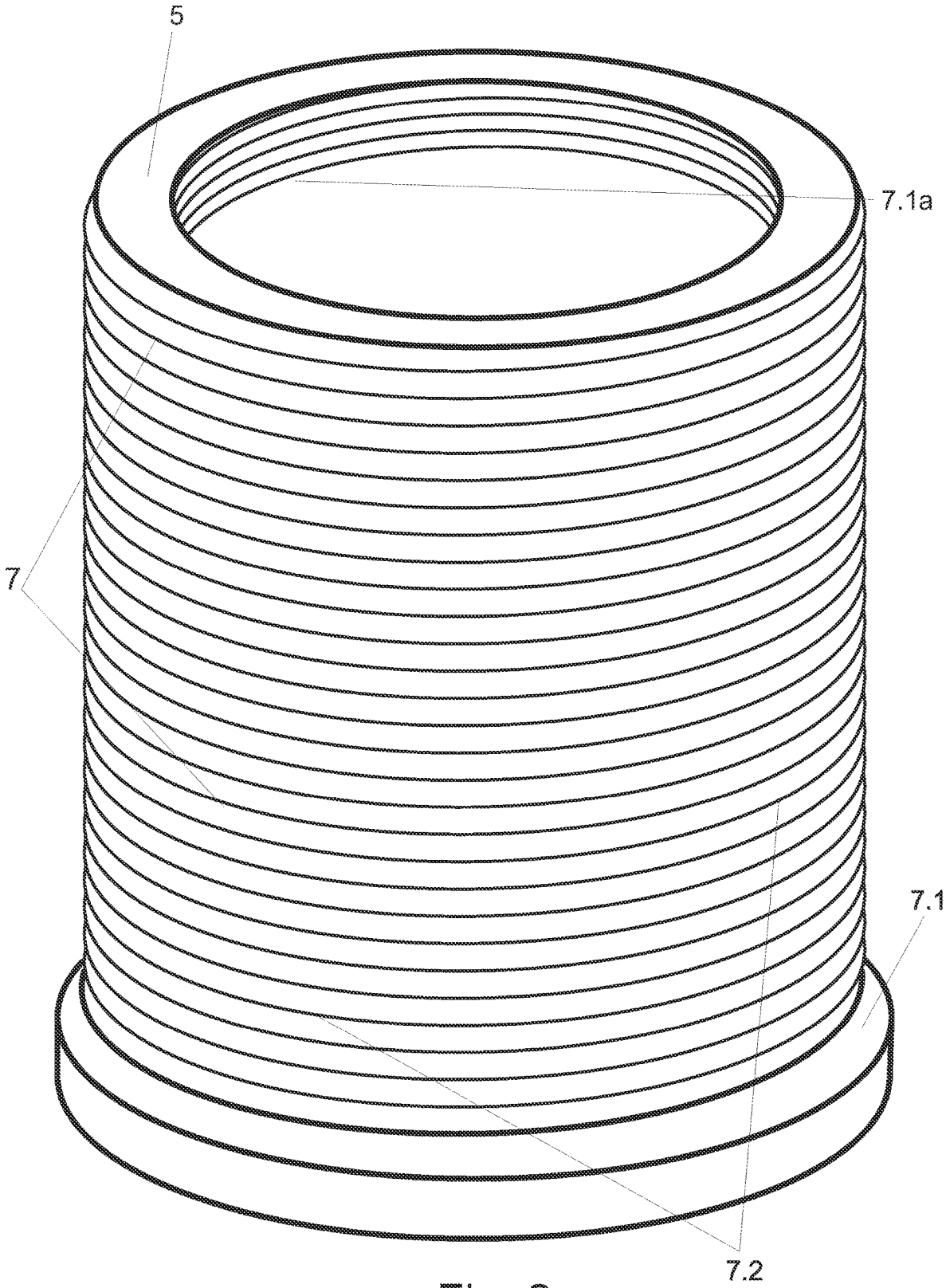

FIG. 2 shows a preferable model of movable threaded tube (7) that will be produced in the desired but compatible dimensions between them, and that will be contiguously inserted throughout the system in the projected number so that they can be able, whenever stimulated through the round driving knob (2), to assume both the rotational and vertical displacements needed to turn the actuator viable and useful.

At the afore-mentioned movable threaded tube (7) it can also be seen the inner collar (4) fitted with threading lines (5) located at the top section of the tube and turned inward, as well as an outer collar (7.1) that also act as a linear advancement limiter (7.1*a*) located at the bottom section of that tube which, when moving up vertically, will touch the inner collar of the larger tube in which it has been inserted so that, at the same time, be prevented of surpass that touching/blocking point, avoiding therefore its disconnection from the telescopic system, as well forcing the contiguous larger tube to assume, from that point on, the same rotational and vertical displacement that is being applied.

As also disclosed by FIG. 2, the rotational and vertical displacement of said movable threaded tube (7) is performed by using an assortment of threads (7.2) disposed across the external body of the movable threaded tube (7), as from the point when they are inserted and threaded into the inner collar of the contiguous larger tube.

Figures 3A, 3B:
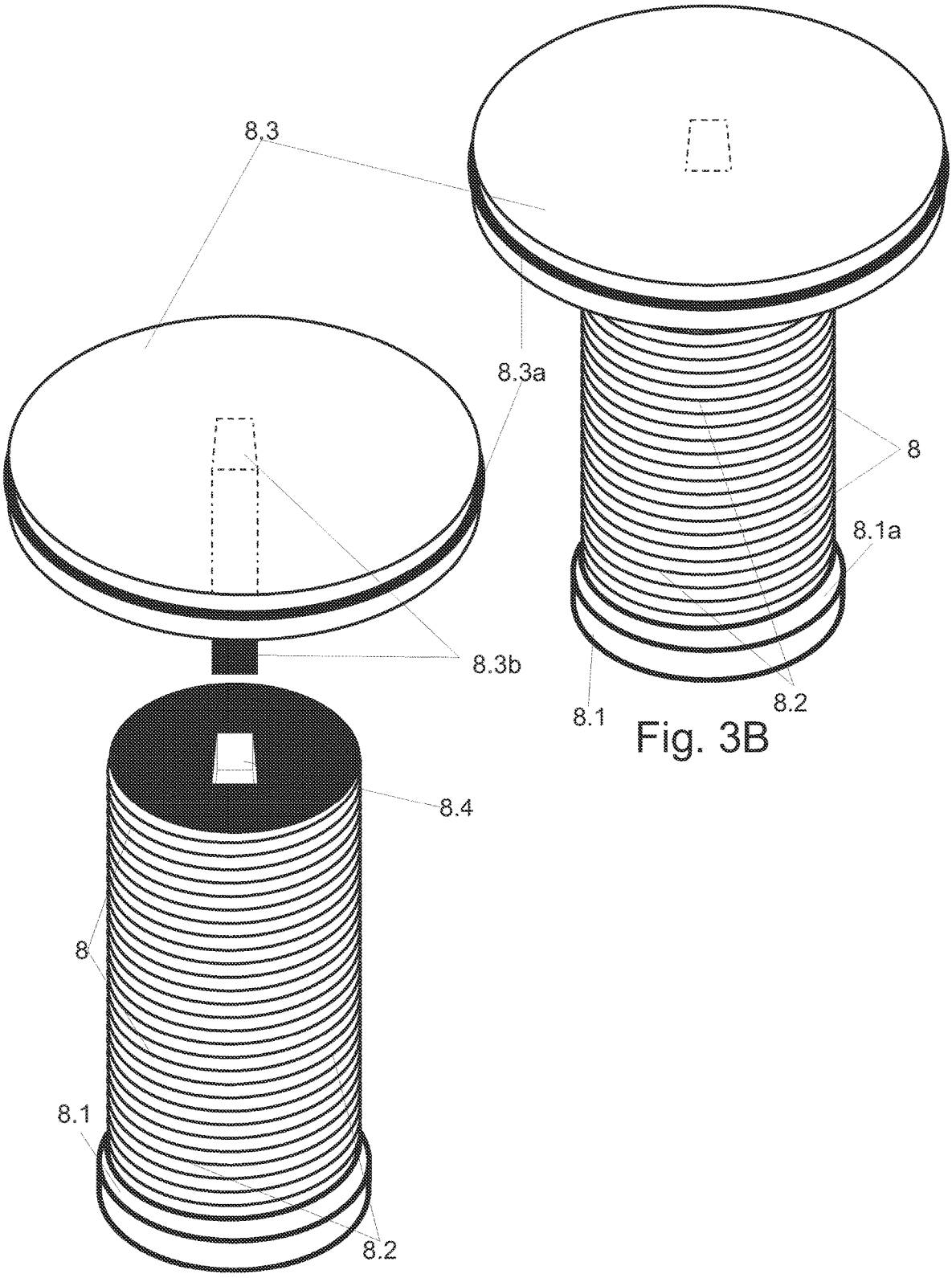

On FIG. 3A it is exposed the central solid threaded column (8) which is intended to be the last existing element between the telescopic system and the target product or object to be manipulated, being this central element also fitted with an outer collar (81) which will also act as an advancement limiter, whose blocking function has been already explained before, and an assortment of threads (8.2) disposed across the external body of this central solid threaded column (8). To accomplish with that aims, the implementation of this central solid threaded column (8) must observe some basic conditions:

a) Only vertical or longitudinal displacements can be allowed to it, whilst any axial displacement must be blocked and not allowed, as it will be better explained ahead, otherwise and if no blockage or hindrance to its axial revolution, the whole set will be loose for rotating axially, without accomplishing with the expected displacement towards the targeted product or object that must be pushed, lifted, smashed or in any other sense manipulated.

b) For some specific applications such as for dispensing pasty products, a piston (8.3), fitted with a locking pivot (8.3*b*) aimed to allow its fixation at the socket (8.4) created on top of the central solid threaded column (8), preferably provided with an "o" ring (8.3*a*) made up of rubber, silicone or the like, and that might prevent any leakage when the stored material is being manipulated, will be also the unique element of the whole telescopic set that will be in tight contact with the walls of the container where the pasty product has been stored, for which it must be built with diameter measures fully compatible with the internal diameter of the storing container, preventing therefore any loose and unproductive axial rotation of said central solid threaded column (8) and of its attached piston (8.3), however totally maintaining both the ability of the whole set to be moving linearly towards the stored product, and the free axial revolution of the remaining telescopic set. FIG. 3B is a perspective view of the set formed by the central solid threaded column (8) and its piston (8.3), upon assembled.

The preliminary steps for the assembling process to conform the self-deployable telescopic actuator and the exemplary device of the present patent is disclosed through the figures from 4A up to 4D.

Figure 4B:
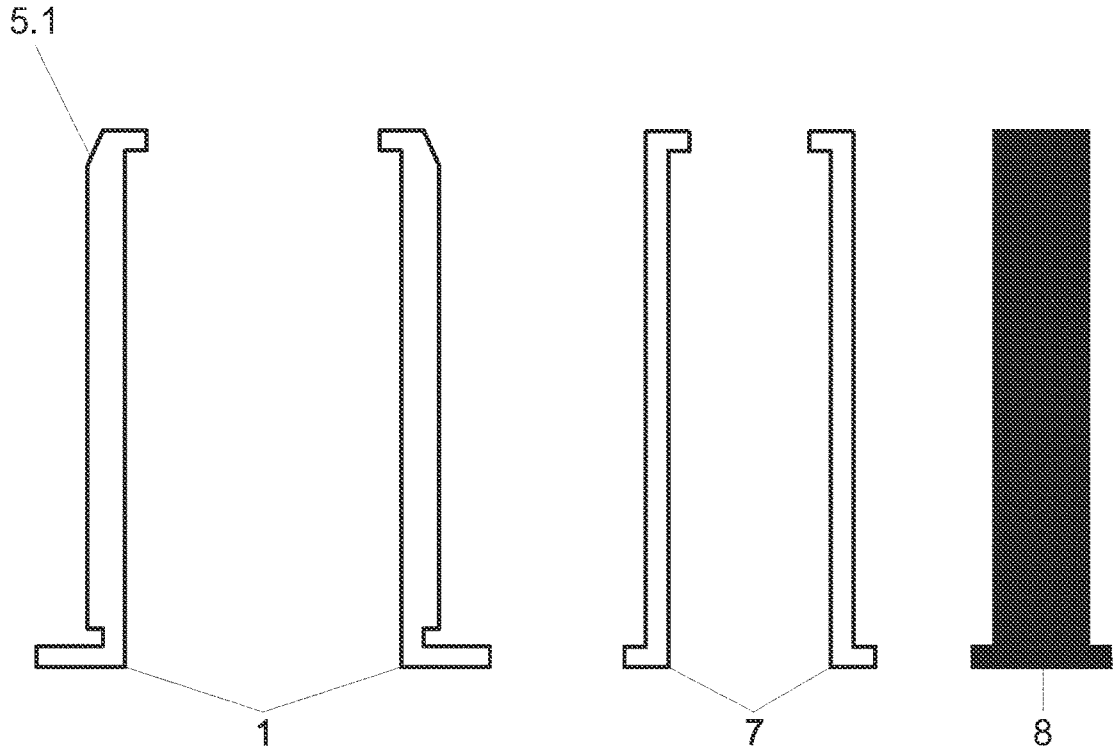
Figure 4A:
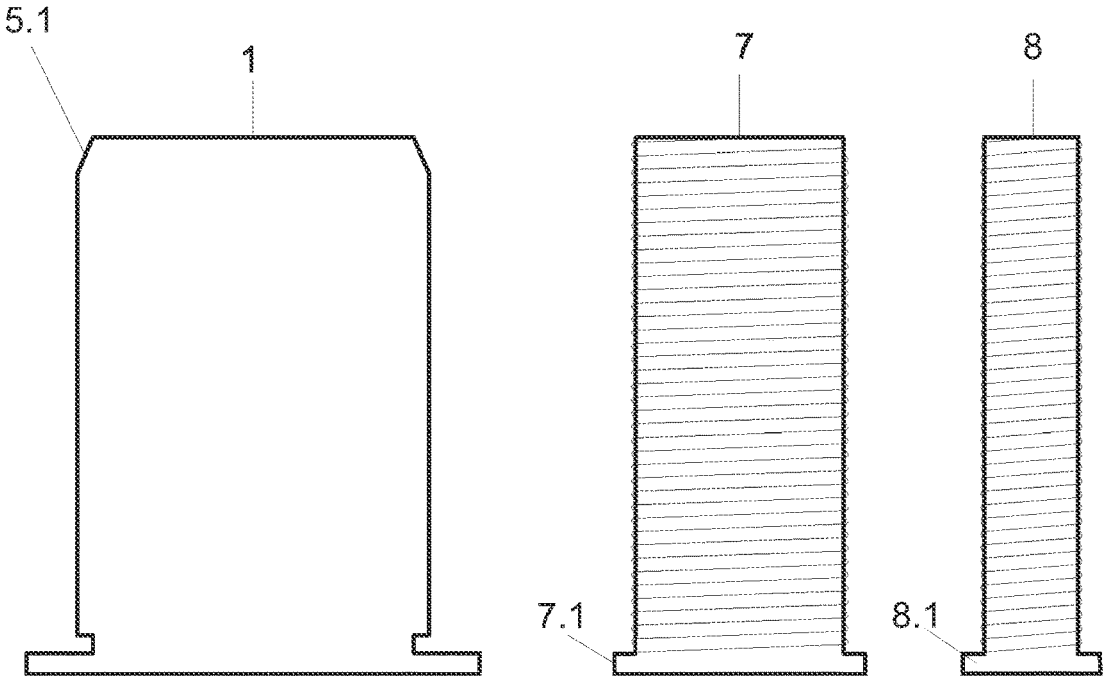

Thus, in FIG. 4A it is exhibit in a front view, three contiguous tube segments used to conform the core of the self-deployable telescopic actuator namely the basic tube (1) completely devoid of external threading lines but fitted with a round driving knob (2) and a groove (6), as well as the tube segments (7) and (3), both fitted with an outer collar (7.1) and (8.1) that will also serve as a linear advancement limiter.

Figure 4C:
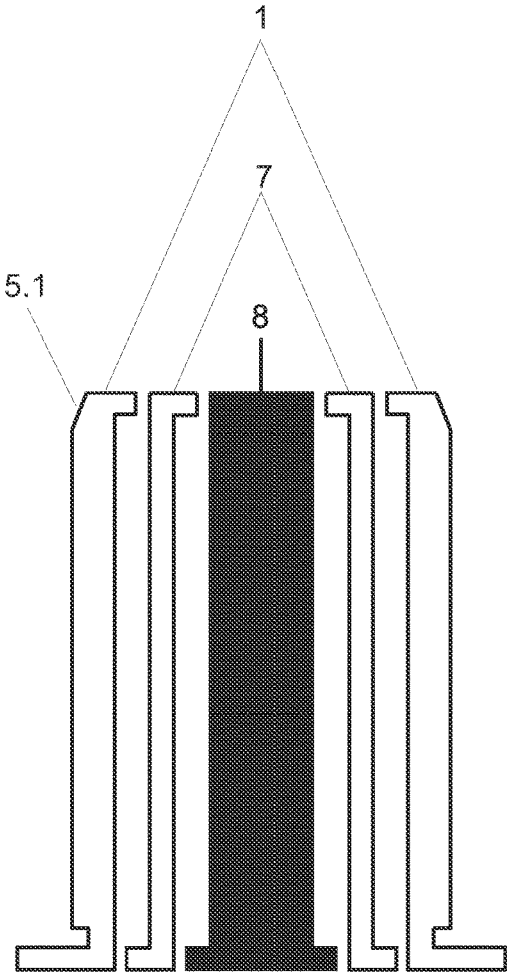

On FIG. 4B, the same tubes described on FIG. 4A are shown up in a cut view whilst in FIG. 4C they have been arranged, all together, exactly as they are going to stay during the total retracting position of the telescopic set.

Figure 4D:
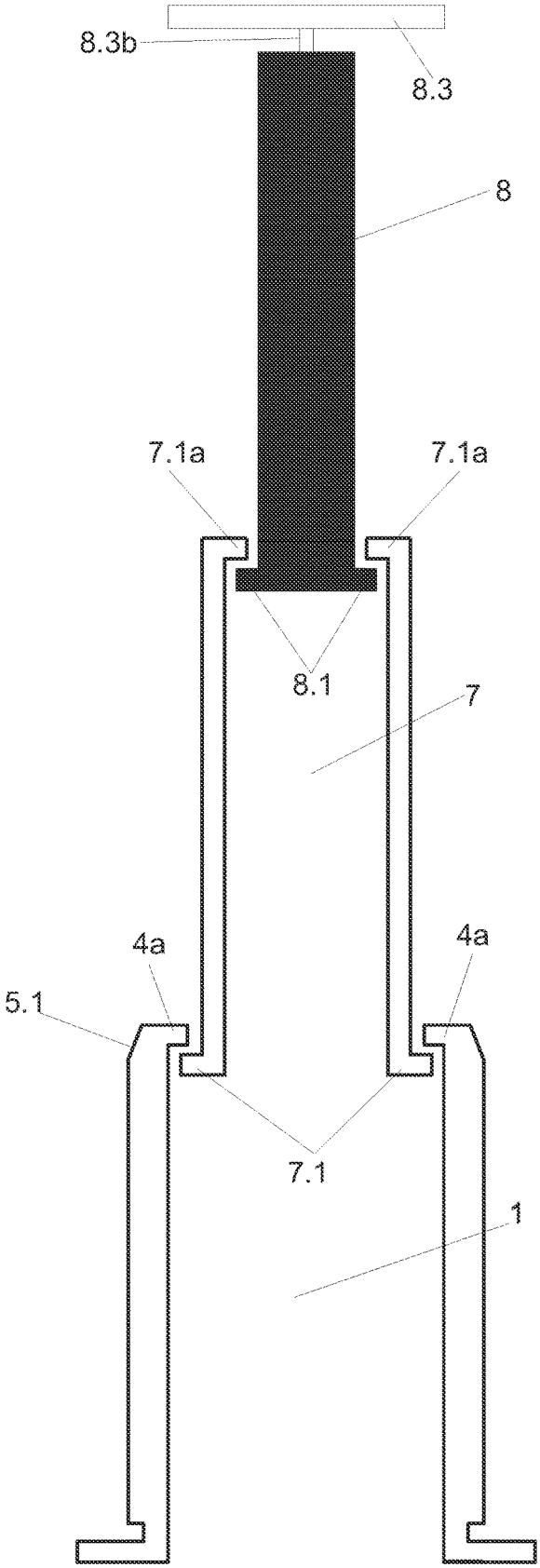

In FIG. 4D, the self-deployable telescopic actuator has been completely opened in its fully extended position.

Figure 5C:
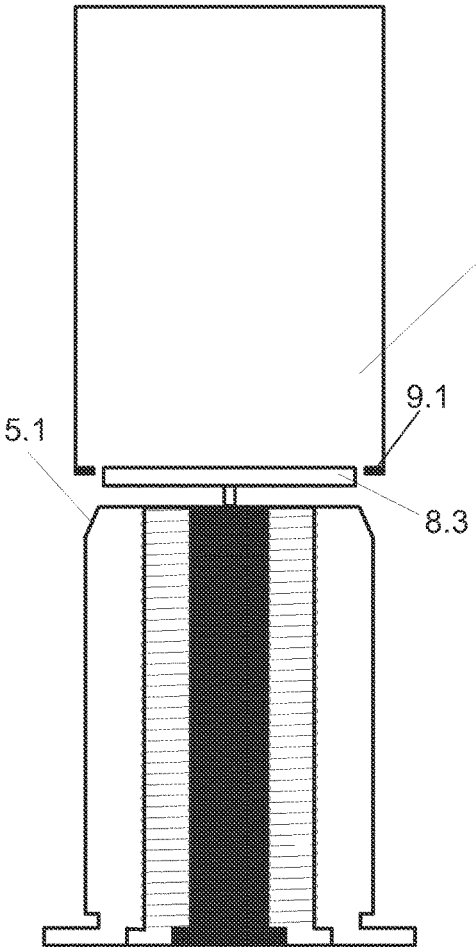
Figure 5D:
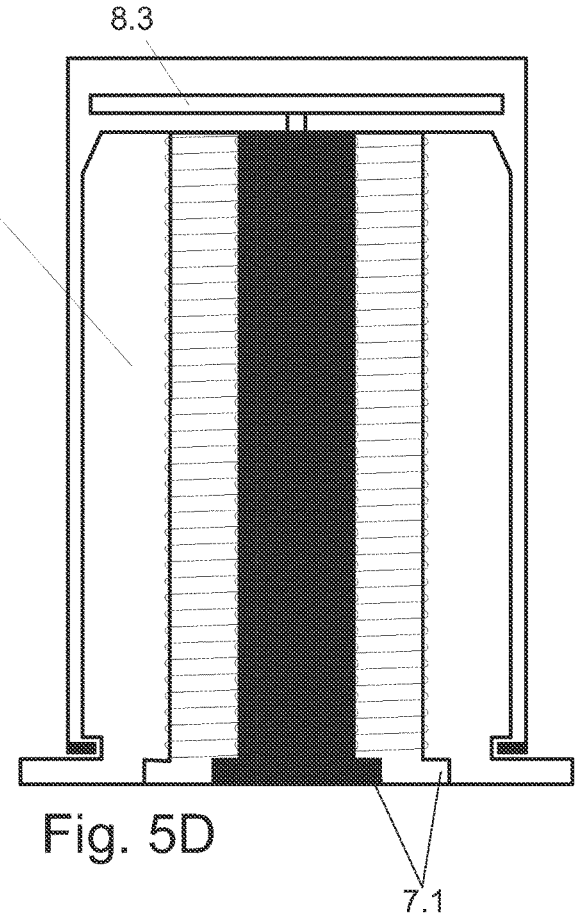
Figure 5A:
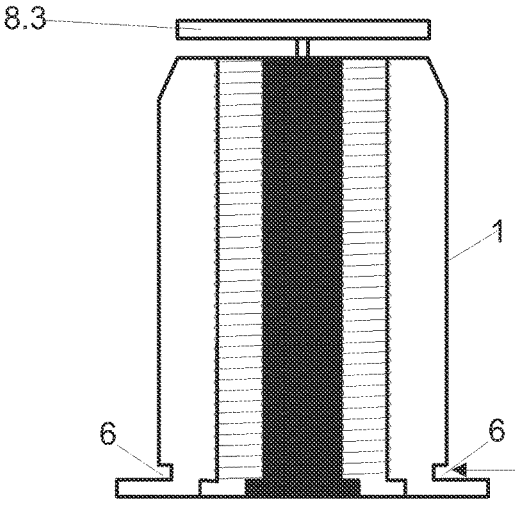

In a front view, FIG. 5A discloses the self-deployable telescopic actuator with their mechanical threaded elements already fully assembled.

Figure 5B:
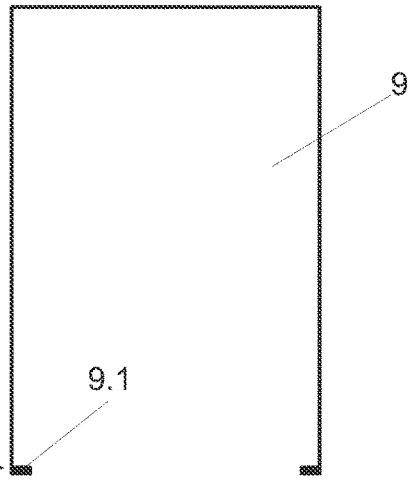
Figure 7C:
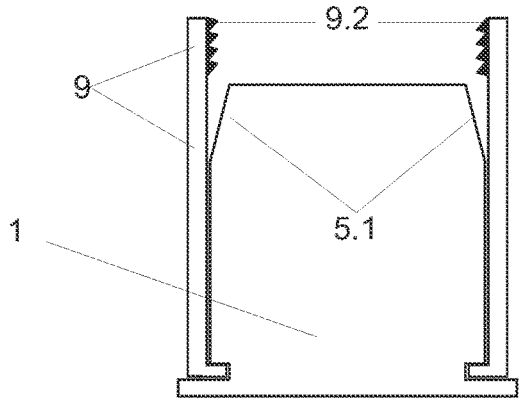
Figure 7B:
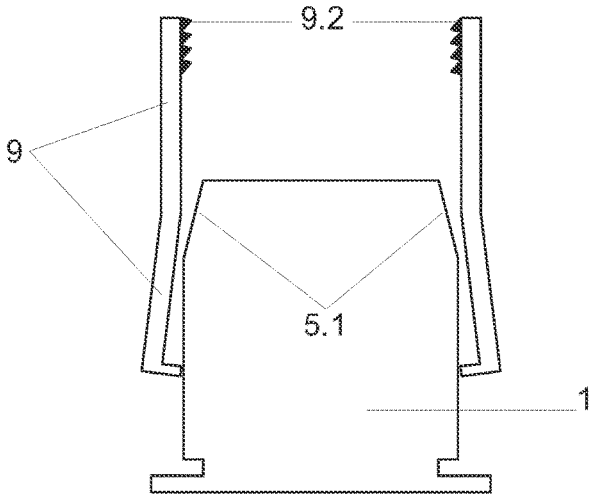
Figure 7A:
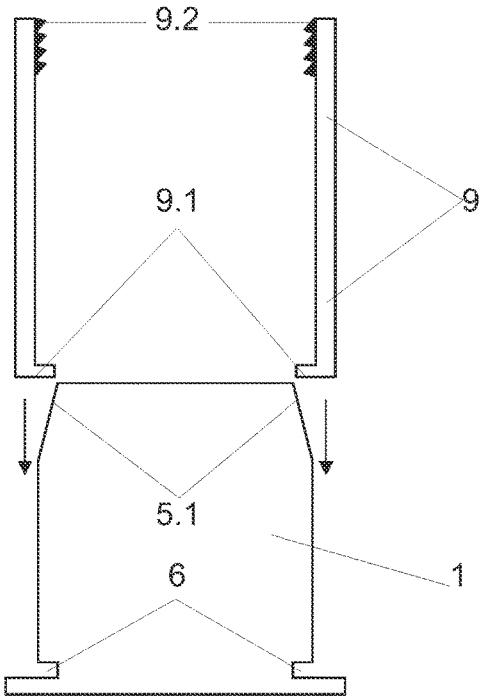

In the specific case of the device object of the present patent, which is to be used as a dispenser for semisolid and pasty goods, the cover sleeve (9) disclosed at FIG. 5B will be put on that already assembled telescopic set, as depicted by FIG. 7A to 7C, to be functioning as a handling holder both for the telescopic set as a whole, and for the container itself, where the product to be dispensed has been stored.

Such an insertion of the cover sleeve (9) will be done, as indicated by FIG. 5C, from top to bottom of the telescopic set until the segmented inner collar (9.1) located at the inner bottom of the cover sleeve (9) meets the groove (6) located at the outer bottom of the basic element (1), as indicated by the arrow (10), where it will be tightly fixed, as indicated by FIG. 5D but still allowing its free axial revolution by the users during the dispensing process, as it will be better described ahead.

Figures 6A, 6B:
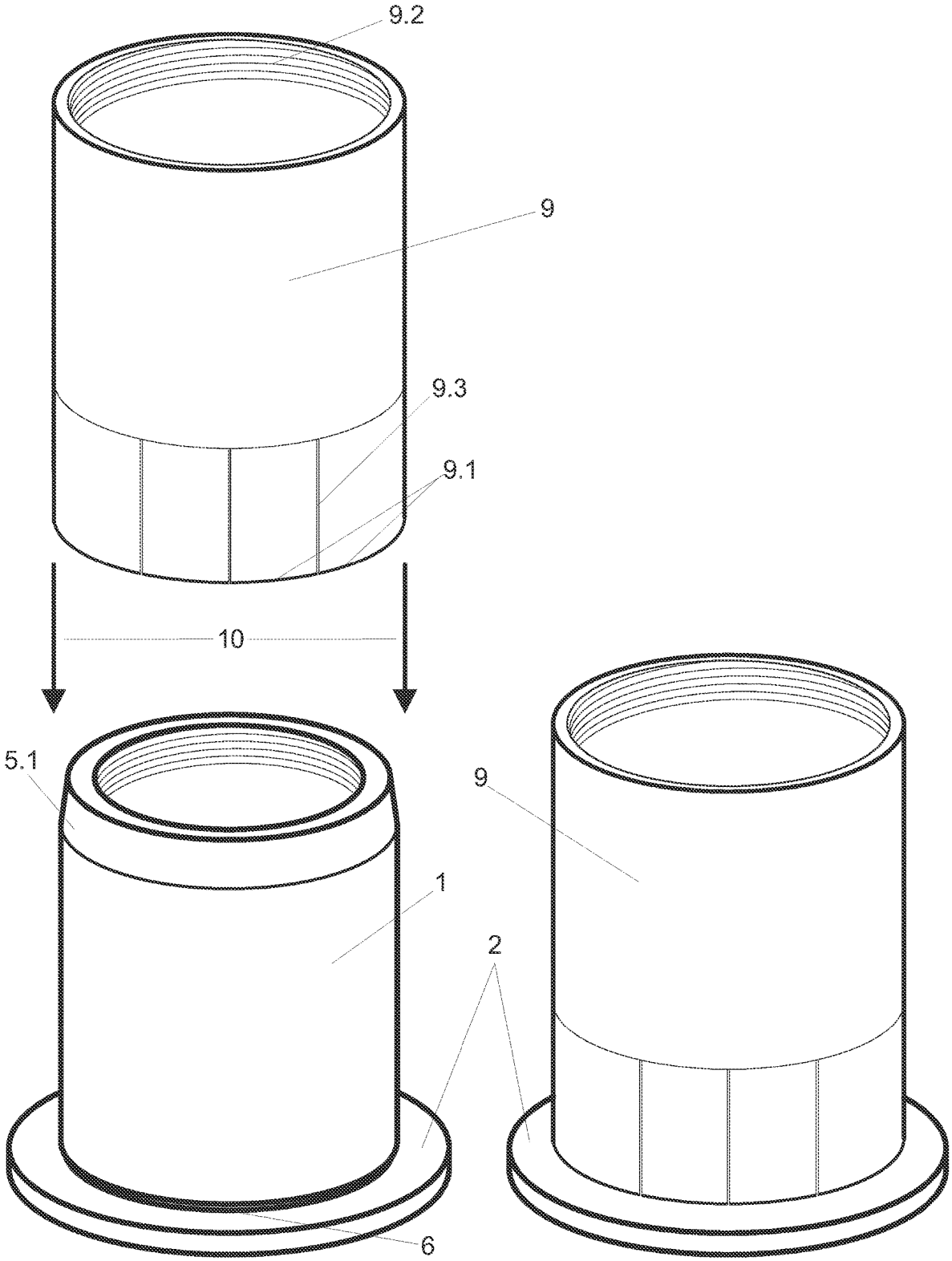

The same insertion process of the cover sleeve (9) around the assembled telescopic set, as disclosed from FIGS. 5A to 50, is again reproduced in a perspective view through FIGS. 6A and 6B.

Thus, in the perspective view of FIG. 6A, it can be noted that the cover sleeve (9), fitted with an inner threaded collar (9.2) at its top end, aimed to receive and retain the container loaded with the selected product, as it will be further disclosed through upcoming figures, has been positioned over the basic tube (1) so that it can be pressed downwards in order to overlay said basic tube (1), as indicated by the arrows (10).

Aiming to facilitate said insertion, that cover sleeve (9) is also fitted at its lower end with longitudinal cuts (9.3), as well as a segmented inner collar (9.1) that, at the end of this insertion, will be introduced and firmly lodged in the groove (6) existing in the bottom of the basic tube (1), as disclosed by FIG. 6B.

On the sequential figures from 7A to 7C it is detailed the necessary steps for getting the basic tube (1) smoothly dressed up by the cover sleeve (9) with the help of slanted portions (5.1) located at the top of the basic tube (1), up to the point when the segmented inner collar (9.1), located at the bottom of the cover sleeve (9) has been tightly connected with the groove (6) also located at the bottom of the basic tube (1).

FIG. 7C shows up the two pieces, i.e., the basic tube (1) and the cover sleeve (9) dully assembled and ready to receive the threaded inner collar located at the top (9.2) of the cover sleeve (9) for the attachment therein of the threaded portion (11.1) located at the bottom of the threaded container.

Figure 8A:
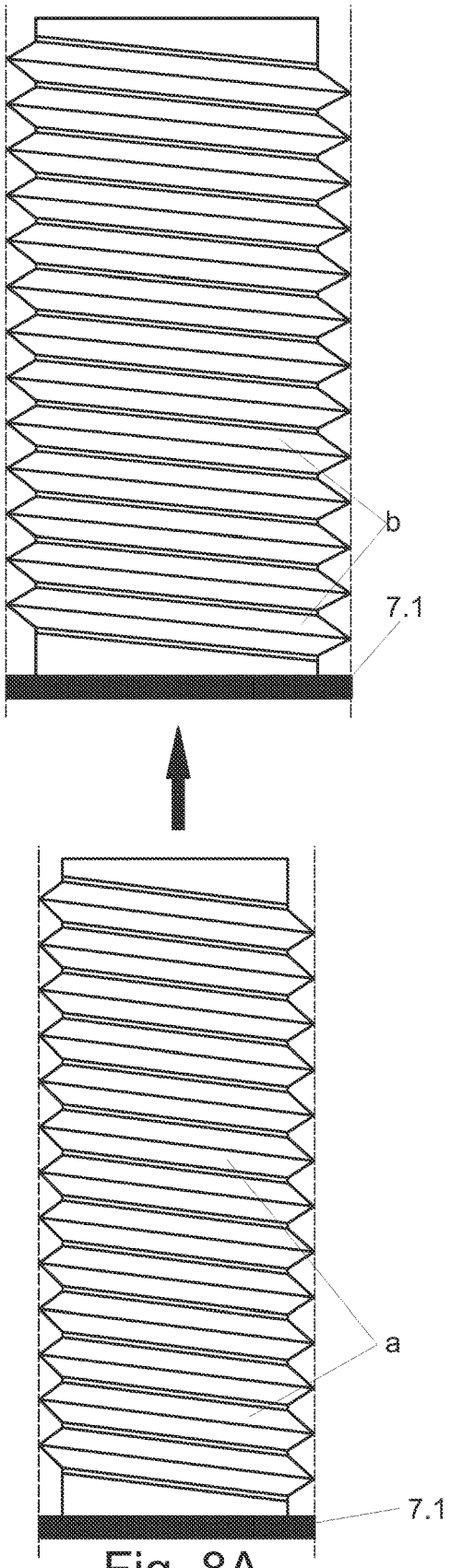
FIG. 8A shows in a front view the insertion of a smaller tube into a larger one to conform the self-deployable telescopic actuator shown up at FIG. 8B.
Figure 8B:
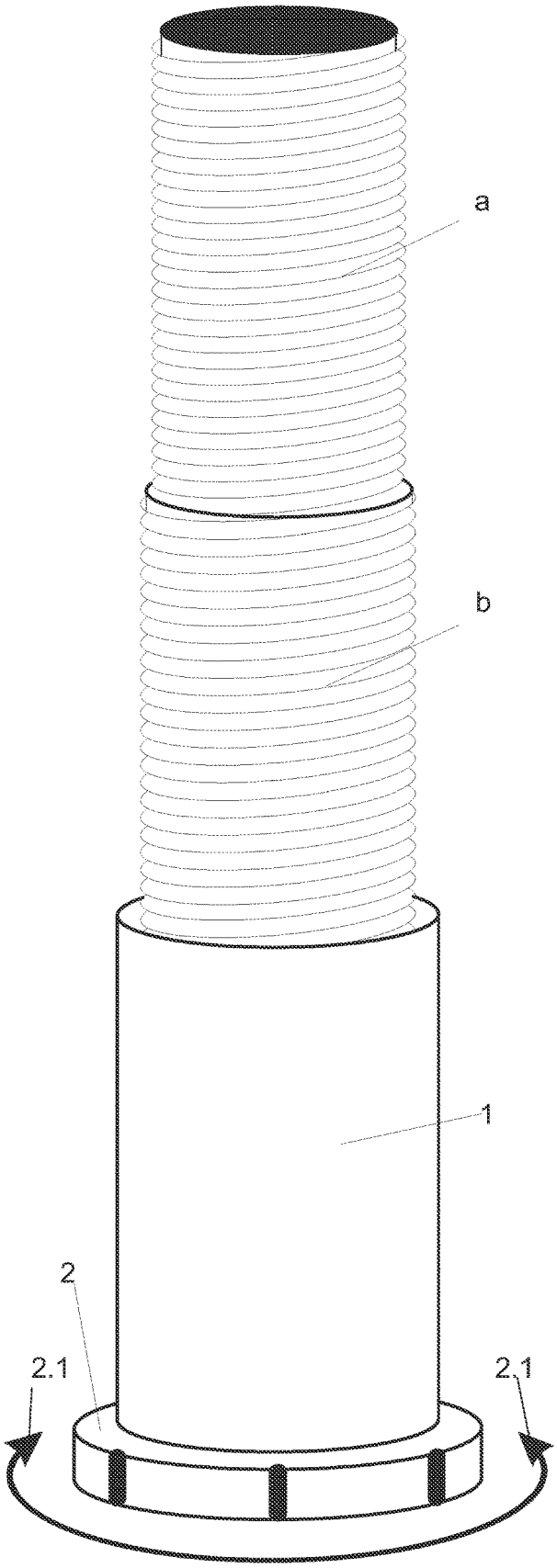

On FIG. 8A it can be seen a front view of two compatible threaded tubes (a) and (b) disposed in a mutual pre-introduction position where a linear advancement limiter represented by the outer collar (7.1), located at the outer bottom of the thinner tube (a), will meet a collar (not shown in this drawing) existing at the inner top of the thicker tube (b), during its longitudinal displacement ahead, inside that thicker tube (b), causing therefore its retention on that meeting point as exposed by FIG. 8B when the both tubes (a) and (b) has been set in motion up to their maximum length, as indicated by the arrow (2.1), by the round driving knob (2). Beyond a variety of advantages targeted by the present patent such as cost effective solution, practicality, easy handling and so on, its main goal is to provide a sustainable and environmentally friendly substitute for many dispensing devices presently in massive use such as plastic toothpaste tubes, for instance, that are still being manufactured as from quite inadequate and dangerous materials and that, after use, are dispose toxically and polluting not only in landfills but sometimes directly to the nature and seas.

Therefore, and taking into consideration the above-named issues, it is proposed the introduction through the present patent, the utilization of dispensing containers that are to be used along with the self-deployable telescopic actuator and device, preferably made up of aluminum by-products or any other eco-friendly material such as glass or some sort of hermetically sealed paperboard or the like.

Figures 9A, 9B:
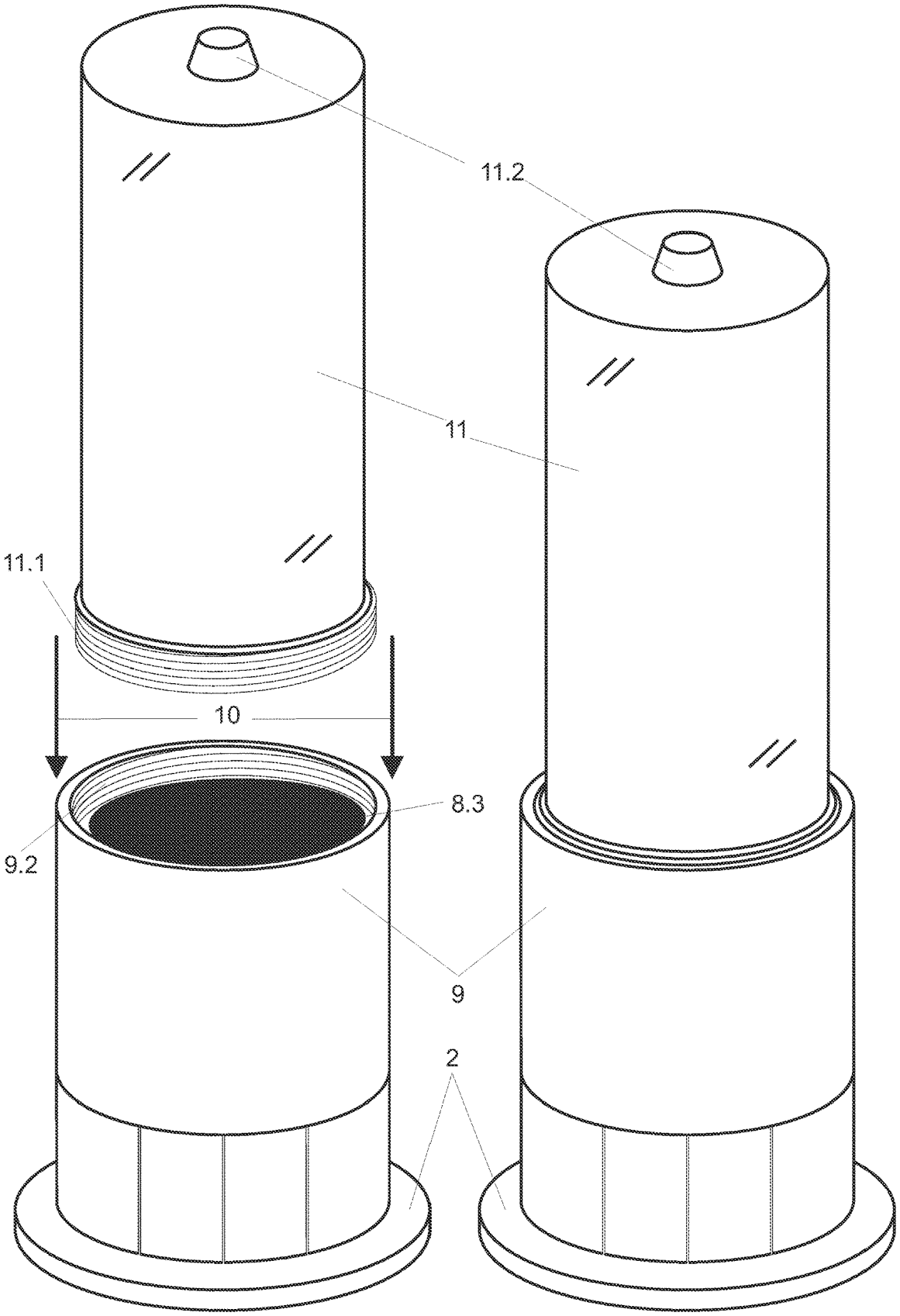
FIG. 9A shows the attaching of a storage container to the self-deployable telescopic actuator for the creation of the dispenser with self-deployable telescopic actuator, shown up at FIG. 9B.

Thus, in the perspective view of FIG. 9A, a threadedly aluminum container (11) shaped in a bottle format, fitted with dispensing nozzle (11.2) at the top and already loaded with the selected product to be dispensed, has been positioned over the full assembled set formed by the self-deployable telescopic actuator and its cover sleeve (9), being ready as indicated by the arrows (10), to be firmly screwed by means of its threadedly bottom portion (11.1) at the inner threaded collar (9.2) located at the inner top of the cover sleeve (9), as indicated by the arrows (10) and exhibited by FIG. 9B.

An alternative method for getting the dispensing container fixed at the telescopic actuator for allowing the extraction of the desired content stored at the container (12) is disclosed through figures from 10A to 10C.

On FIG. 10A it can be noted another sort of bottle shaped container (12), likewise fitted with a dispensing nozzle (11.2) however not having at its bottom end the same outer threaded collar, as disclosed through FIGS. 9A and 9B, but instead, a flat and not threaded collar (12.1) which is to be lodged on the round space available on top of the cover sleeve (9).

Also present in the FIG. 10A is a retaining threaded element (12.2) which, according to FIG. 10B will be slide throughout the container (12), after it has been lodged inside the cover sleeve (9), until it meets the inner threaded collar located at the top of the cover sleeve (9) when it will be threaded down towards the flat collar (12.1) that will be, this way, firmly attached to the telescopic actuator. On FIG. 10B an auxiliary disc (13) has been positioned right below the open end (12.3) of the container (12), where the stored product (14) is exposed, while at FIG. 10C, said stored product (14) was pressed upwards by the telescopic actuator, consequently causing part the stored product (14.1) to be dispensed through the nozzle (11.2).

The same assembling process described through figures from 10A to 10C is once again reproduced in perspective views through figures from 11A to 11C wherein the two possible movements might be triggered either manually or electrically by users of the present device to extract the desired portions of its content. It must be considered that upon ready for use, the herein described dispensing device will be divided in two sections, i.e., a lower section and an upper section, and that these two independent sections of the dispenser, after they have been connected, might be subjected to axial rotations, clockwise or anticlockwise, as indicated by the double directions arrow (15), pending upon the intention of extending or retracting the telescopic elements.

Such axial rotations will be implemented through the round driving knob (2) located at the bottom of the basic tube (1).

Figures 11A, 11B, 11C:
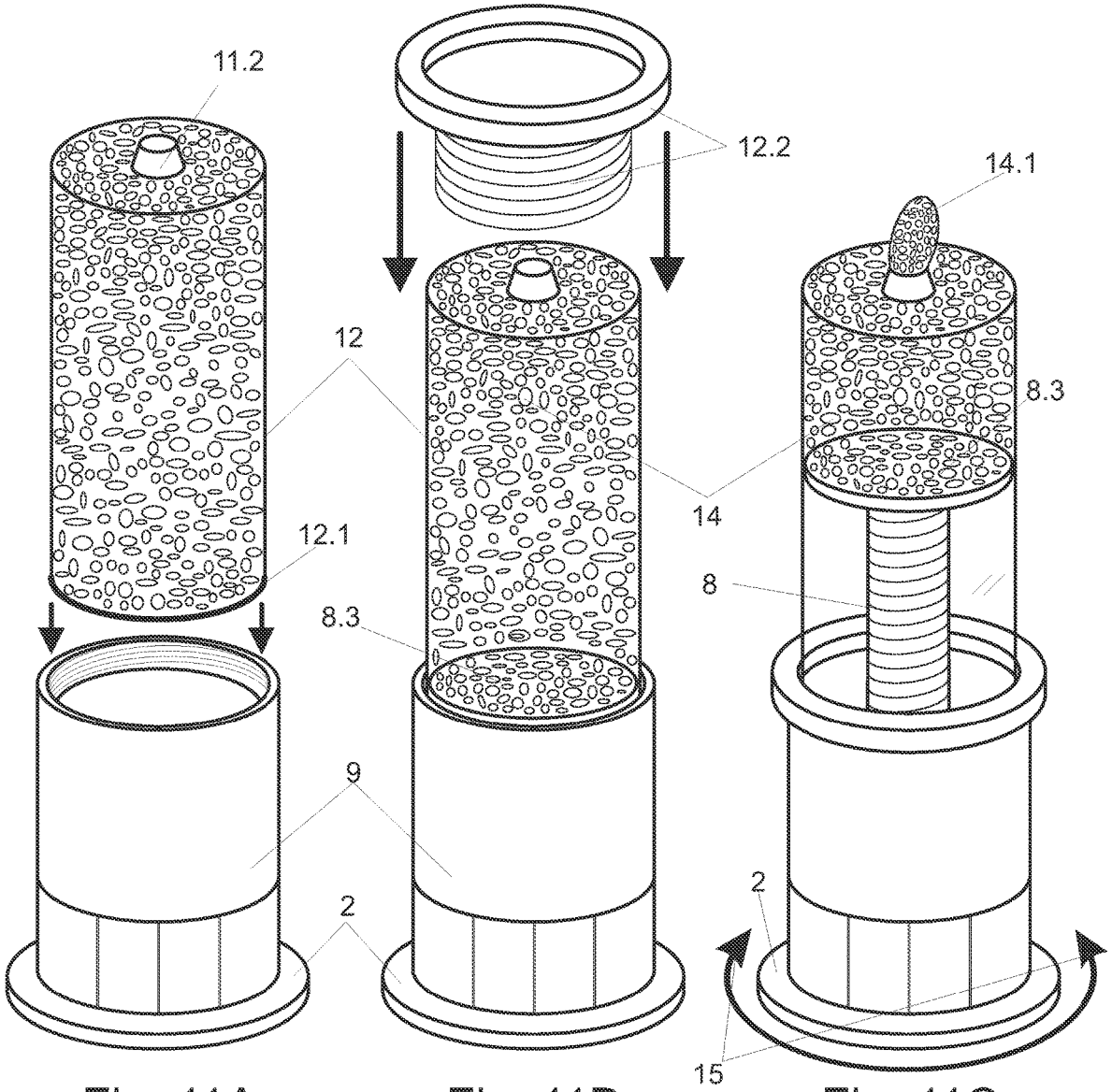

In such a case, the other section of the device, comprised by the set formed by the container (12) and the cover sleeve (9), must be kept motionless by the user, while the telescopic actuator is being rotated to the desired direction, for expansion or retraction, as exhibited on FIG. 11C.

Once that an axial rotation has been applied, the whole system will be set in motion in a joint axial rotation mainly to progressively extend the telescopic system in order to expel the content stored at the container (12) through its nozzle (11.2), exception for the central solid element (8) of the whole system which, due to the pressure exerted by the contact on the walls of the container (12) by the piston (8.3), it will be kept motionless but only in terms of axial rotation, however still able to proceed vertically ahead towards the stored product to be dispensed, causing therefore the whole telescopic system be extend ahead and upwardly. Despite the fact that a threaded container in bottle shape, made up as from aluminum alloy and fitted with a threadedly portion or a flat disc at its bottom is being used as a preferred embodiment to depict the present invention and validate its functionalities, it must be considered that any and viable construction variation, both regarding the container's shape or the system with which it will be attached to the cover sleeve is naturally covered and protected by the present invention.

Also, the technical and industrial methods to produce the aluminum containers herein exemplified may largely vary without limiting the spirit and scope of the invention. As such, it will be appreciated by persons skilled in the art that the present invention is not limited by what has been shown and described hereinabove.

The invention claimed is:

1. A Dispenser with Self-deployable Telescopic Actuator divided in two independent but complementary sections, the lower section represented by a self-deployable telescopic actuator comprising a base tube, intermediary tubes, a central solid threaded column, all of them fitted with mutually compatible threaded lines at their internal, external and/or at both of their sides, a rotatable cover sleeve outfitted with a threaded inner collar at its top and a segmented inner collar at its bottom; the upper section represented by a dispensing container for storing the product to be dispensed, outfitted with a dispensing nozzle at its top and a threaded collar at its bottom, wherein the upper section is connected to the lower section by means of its inner collar located at its bottom to the threaded inner collar available at the top of the rotatable cover sleeve that covers the lower section, to conform a Dispenser with Self-deployable Telescopic Actuator.

2. The Dispenser with Self-deployable Telescopic Actuator as in claim 1, wherein the base tube comprises an outer round driving knob located at its bottom to allow the rotation of the entire telescopic set; a slanted termination on its top to facilitate the insertion of the cover sleeve; an inner threaded collar at its top to act as a linear advancement limiter; a groove located at its bottom for lodging and retaining the cover sleeve; a driving knob at its bottom end.

3. The Dispenser with Self-deployable Telescopic Actuator as in claim 1, wherein the cover sleeve comprises longitudinal cuts at its lower half end; a segmented inner collar at its bottom; and a threaded inner collar at its top for holding the dispensing container.

4. The Dispenser with Self-deployable Telescopic Actuator as in claim 1, wherein the intermediary tubes comprise; screw threads spread out all over their outer wall; an inner threaded collar at their top to act as a linear advancement limiter; an outer collar at their bottom to act as a linear advancement limiter.

5. The Dispenser with Self-deployable Telescopic Actuator as in claim 1, wherein the central solid threaded column comprises; screw threads spread out all over its length; a socket at its central top; an outer collar at their bottom to act as a linear advancement limiter.

6. The Dispenser with Self-deployable Telescopic Actuator as in claim 1, wherein a piston that pushes the dispensable products is inserted into the socket existing at central top of the central solid threaded column by means of a locking pivot existing under said piston.

7. The Dispenser with Self-deployable Telescopic Actuator as in claim 1, wherein a given sequential number of threaded tubes of progressively thinner diameter but fully compatible among them is inserted and threaded one inside the others, as from a common base and through the insertion of the top of the smaller diameter tube into the bottom of the larger diameter tube and so forth, aiming the creation of a workable self-deployable telescopic actuator.

8. The Dispenser with Self-deployable Telescopic Actuator as in claim 1, wherein upon connected, the two independent sections of the dispenser can be axially rotated clockwise or anticlockwise for extending or retracting the telescopic elements for lifting, pushing or dispensing things by kinetic impulses applied through the driving knob existing at the bottom of the base tube.

9. The Dispenser with Self-deployable Telescopic Actuator as in claim 1, wherein rotational impulses are transmitted to the whole system as from a driving knob embodied to the base tube.

10. The Dispenser with Self-deployable Telescopic Actuator as in claim 1, wherein the method for sequentially inserting threaded tubes comprise tubes of progressively thinner diameters as from a common base; advancement limiters such as outer and inner collars located either at the top and at the bottom of said tubes aiming the locking of their axial rotation at a certain common point in their courses, consequently making that, as from that point on they jointly assume the same axial and longitudinal displacement for the creation of a self-expanding and self-retracting telescopic actuator.

11. The Dispenser with Self-deployable Telescopic Actuator as in claim 1, wherein whenever a rotational movement to extend the present telescopic system to its maximum desired limit is applied to the system, the self-locking of the tubes will occur when asymmetric lower portions of any segment of smaller diameter tube touches the upper portions of any segment of larger diameter tube when, due to the asymmetrical shape of both tubes at these points, there will be no more space to continue the threading movement, determining therefore the maximum expansive limit that the system is able to reach, although it will still be possible to rotate the tube segments in the opposite direction previously assumed, thus allowing not only the unlocking of all existing tube segments, but also of the entire telescopic system, which will allow a partial or total retraction of the whole telescopic system.

12. The Dispenser with Self-deployable Telescopic Actuator as in claim 1, wherein feasible methods for building devices and tools synergistically activated by the self-deployable telescopic actuator comprise the alternative use of tapered threaded tube segments of progressively smaller internal and external diameters as from a common base, in which the smaller diameter threaded tube segments will be progressively introduced, as from their smaller diameter thread sections, into the segments of threaded pipes of larger diameter, from their threaded sections of larger diameter, up to a point where due to the asymmetry of their internal and external threads, the threaded tube segments will lock, one on the other, forcing them to assume the direction of rotation applied for expansion or retraction of the entire system; the use of threaded pipe with progressively smaller internal and external diameters from a common base, formed by parallel side walls equipped with internal and external threads, and which contain, both at their base of their external walls, thread portions with a diameter slightly larger than the diameter of the rest of its external threads, or at the top of its internal walls, portions of thread with a diameter slightly larger than the diameter of the rest of its internal threads, so as to cause, at this point of contact between the two, the locking of these tubes, one in the other thus allowing that together they assume the same rotational movement applied to the entire telescopic assembly; the use of threaded pipe with progressively smaller internal and external diameters from a common base, formed by parallel side walls equipped with internal and external threads and which also contain, both on their external and internal walls, threading stroke with diameters slightly larger than the diameter of their threads so that they act as stops that not only prevent the smaller diameter tube from continuing its rotating threading indefinitely until, and consequently, they disconnect from the larger diameter tube they are in inserted, but also to obtain at this point of contact between the two, the locking of both one in the other, thus allowing that all together they assume the same rotational movement applied to the entire telescopic assembly.

13. The Dispenser with Self-deployable Telescopic Actuator as in claim 1, wherein functional conditions for the self-expansion of the telescopic system occur comprise firstly that the basic threaded tube be attached to a shared handling support so that axial movements can be manually or electrically applied to the round rotary knob and therefrom to all other threaded tube segments; secondly, that all tubes positioned within the basic tube assume the same axial movements synergistically transmitted by the basic tube, but that can also be moving longitudinally, excepted for the smaller diameter central tube which will be able to move only vertically, being its axial rotation necessarily prevented to permit the longitudinal displacement of the whole telescopic actuator up to a predetermined point.

14. The Dispenser with Self-deployable Telescopic Actuator as in claim 1, wherein the cover sleeve is fixed on the assembled telescopic set for holding and sustain the dispensing container; to act as the handling holder that allows the user, with the aid of a driving knob, the free revolution of the telescopic actuator towards the chosen axial direction; for dispensing the stored products or retract the telescopic actuator.

15. The Dispenser with Self-deployable Telescopic Actuator as in claim 1, wherein the dispensing container is fixed at the cover sleeve by means of its outer flat collar located at its bottom end, lodged at the round space available on top of the cover sleeve; a fastening screw nut to be screwed at the inner threaded collar located on top of the cover sleeve.

16. The Dispenser with Self-deployable Telescopic Actuator as in claim 1, wherein the dispensing containers used along with the self-deployable telescopic actuator is made up of aluminum by-products or any other eco-friendly material such as glass or some sort of hermetically sealed paperboard or the like.

* * * * *